US007727039B2

(12) United States Patent
Baik et al.

(10) Patent No.: US 7,727,039 B2
(45) Date of Patent: Jun. 1, 2010

(54) METHOD OF AGING FIELD EMISSION DEVICES

(75) Inventors: Chan-wook Baik, Yongin-si (KR); Sun-il Kim, Yongin-si (KR); Deuk-seok Chung, Yongin-si (KR); Byong-gwon Song, Yongin-si (KR); Min-jong Bae, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 323 days.

(21) Appl. No.: 11/806,658

(22) Filed: Jun. 1, 2007

(65) Prior Publication Data

US 2008/0119104 A1 May 22, 2008

(30) Foreign Application Priority Data

Nov. 22, 2006 (KR) ..... 10-2006-0116040

(51) Int. Cl.
*H01J 9/00* (2006.01)
*G09G 3/00* (2006.01)

(52) U.S. Cl. ..... 445/6; 445/24; 315/169.1; 345/75.2

(58) Field of Classification Search ..... 455/62, 455/3, 6, 24, 25; 345/75.2, 215; 315/169.1, 315/169.2

See application file for complete search history.

(56) References Cited

U.S. PATENT DOCUMENTS 5,587,720 A * 12/1996 Fukuta et al. ..... 345/75.2
6,512,335 B1 * 1/2003 Dunphy et al. ..... 315/169.3

FOREIGN PATENT DOCUMENTS

KR 10-2004-0090799 10/2004
KR 10-2004-0102791 * 12/2004
KR 10-2005-0105409 11/2005
KR 10-2006-0020288 3/2006

OTHER PUBLICATIONS

Office Action from the Korean Intellectual Property Office issued in Applicant's corresponding Korean Patent Application No. 10-2006-0116040 dated Oct. 23, 2007.

* cited by examiner

*Primary Examiner*—Karabi Guharay
*Assistant Examiner*—Sheryl Hull
(74) *Attorney, Agent, or Firm*—Cantor Colburn LLP

(57) ABSTRACT

A method of aging a field emission device including a cathode and an anode arranged parallel to each other, an emitter arranged on the cathode to emit electrons to the anode, and a gate electrode arranged on the cathode adjacent to the emitter, the method including: supplying a voltage to the cathode; supplying a voltage to the gate; and then supplying a sufficiently low voltage to the anode so as to prevent a short-circuited portion between the cathode and the gate electrode from being permanently damaged due to an overcurrent.

12 Claims, 9 Drawing Sheets

39.1 V – 200 μA
(10 LINES)

41.9 V – 430 μA
(7 LINES)

53.8 V – 1.59 mA
(5 LINES)

53.3 V – 1.6 mA
(4 LINES)

54 V – 1.5 mA
(3 LINES)

54 V – 1.6 mA
(2 LINES)

54 V – 1.5 mA
(1 LINE)

54 V – 1.5 mA
(0 LINE)

METHOD OF AGING FIELD EMISSION DEVICES

CLAIM OF PRIORITY

This application makes reference to, incorporates the same herein, and claims all benefits accruing under 35 U.S.C.§119 from an application for METHOD OF AGING FIELD EMISSION DEVICE earlier filed in the Korean Intellectual Property Office on 22 Nov. 2006 and there duly assigned Serial No. 10-2006-0116040.

BACKGROUND OF THE INVENTION

1. Field of the Invention

The present invention relates to a method of aging a field emission device, and more particularly, to a method of aging a field emission device by which the problem of short circuits produced during the fabrication of the field emission device can be overcome, thus enabling normal operation of the field emission device.

2. Description of the Related Art

In general, electron emission devices may be categorized into devices using a hot cathode as an electron emitter or devices using a cold cathode as the electron emitter. As is well known, electron emission devices using a cold cathode may be classified into Field Emitter Array (FEA) devices, Surface Conduction Emitter (SCE) devices, Metal Insulator Metal (MIM) devices, Metal Insulator Semiconductor (MIS) devices, and Ballistic Electron Surface Emitting (BSE) devices.

FEA electron emission devices are known as field emission devices. A field emission device operates on the principle that when an electron emitter is formed of a material having a small work function or a large B function, electrons are easily emitted due to a tunneling effect caused by an electric field in a vacuum. The electron emitter may have a tip structure with pointed tips, which may be formed of molybdenum (Mo) or silicon (Si) or be formed of graphite or Diamond like Carbon (DLC). In recent years, field emission devices have been fabricated using nano-materials, such as nanotubes or nanowires, as the election emitter.

Field emission devices may be classified into diode field emission devices and triode field emission devices depending on the arrangement of their electrodes. Specifically, a diode field emission device includes a cathode having a top surface on which an electron emitter is disposed and an anode disposed opposite the cathode. In a diode field emission device, electrons are emitted due to a potential difference between the cathode and the anode. A triode field emission device includes the same cathode and anode as a diode field emission device and further includes a gate electrode disposed adjacent to the cathode to discharge electrons. A Field Emission Display (FED) using a field emission device includes a fluorescent material layer that is arranged on a surface of an anode, so that electrons emitted from an emitter may be accelerated and contact the fluorescent material layer to emit light.

A field emission device undergoes an aging process in order to secure stable performance after the field emission device is manufactured. An example of a conventional aging method is to raise a voltage supplied to an anode slowly or to supply a smaller-width pulse signal with a rise in voltage, as discussed in Korean Patent Publication No. 2004-90799. Also, a method of raising voltages of an anode, a gate electrode, and a cathode by degrees is discussed in Korean Patent Publication No. 2005-105409. In still another example, Korean Patent Publication No. 2006-20288 introduces a method in which a current is periodically measured, and when the current is smaller than a target current, the current is increased by feedback. However, these conventional methods do not provide a method of repairing a short circuit of a field emission device, which is detected in an initial stage of an aging process.

FIGS. 1A through 1C are photographic images of types of short circuits of a triode field emission device. The triode field emission device shown in FIGS. 1A through 1C employs an emitter formed of Carbon NanoTubes (CNTs).

The causes of the short circuits of the triode field emission devices shown in FIGS. 1A through 1C are as follows. First, referring to FIG. 1A, during formation of an emitter 5 of a triode field emission device, the emitter 5 may be misaligned with a central portion of an emitter hole 3 so that the emitter 5 comes very close to or into contact with a gate electrode 2. Second, referring to FIG. 1B, a portion of an emitter 5 extends like a fine thread (refer to 5A in FIG. 1B) and contacts a gate electrode 2. Third, referring to FIG. 1C, a gate electrode 2 is connected to a cathode 1 due to CNT emitters or an extraneous substance 6.

Therefore, when a conventional aging process is performed on a field emission device having a short-circuited portion, overcurrent flows into the short-circuited portion and a large electric arc may occur, with the result that the short-circuited portion may be permanently damaged.

FIG. 2 is a photographic image of an FED 10 that is permanently damaged after a conventional aging process. Referring to FIG. 2, when a normal driving voltage is supplied to an anode and a cathode after a conventional aging process is performed on the FED, electron beams are not emitted from permanently damaged portions. Thus, it can be confirmed that a plurality of horizontal lines from which electron beams are not emitted are formed. The horizontal lines appear after the FED performs a scan operation in a horizontal direction. In a steady mode, electrons collide with a fluorescent layer coated on an anode so that light is emitted. However, the horizontal lines where light cannot be emitted 11 since a voltage is not supplied to a permanently damaged scan line.

SUMMARY OF THE INVENTION

The present invention provides a method of aging a field emission device, which overcomes the problem of short circuits produced during the fabrication of the field emission device, thus enabling normal operation of the field emission device.

According to an aspect of the present invention, a method of aging a field emission device including a cathode and an anode arranged parallel to each other, an emitter arranged on the cathode to emit electrons to the anode, and a gate electrode arranged on the cathode adjacent to the emitter is provided, the method including: supplying a voltage to the cathode; supplying a voltage to the gate; and then supplying a sufficiently low voltage to the anode so as to prevent a short-circuited portion between the cathode and the gate electrode from being permanently damaged due to an overcurrent.

The voltage supplied to the anode may be a DC voltage ranging from 0.1 to 1 kV.

A constant voltage may be supplied to the anode.

A potential difference between the gate electrode and the cathode may range from 0 to 200 V.

A voltage supplied to the cathode may be a ground voltage, and a voltage supplied to the gate electrode may be a positive (+) voltage.

The method may further include increasing the voltage supplied to the gate electrode at a rising rate of 0 to 60 V/min.

The method may further include sequentially increasing the voltage supplied to the gate electrode at a rate of 0 to 60 V/min, then dropping the voltage supplied to the gate electrode intermittently, and then again increasing the voltage supplied to the gate electrode.

The method may further include sequentially reducing the voltage supplied to the gate electrode each time the voltage supplied to the gate electrode rises by as much as 10 V, and then again increasing the voltage supplied to the gate electrode. In this case, the voltage supplied to the gate electrode voltage may be reduced to a value corresponding to the average of an initial voltage and a final voltage of a voltage rising period.

A voltage supplied to the gate electrode may be a ground voltage, and a voltage supplied to the cathode may be a negative (−) voltage.

The method may further include reducing the voltage supplied to the cathode at a falling rate of 0 to −60 V/min.

The method may further include sequentially reducing the voltage supplied to the cathode at a falling rate of 0 to −60 V/min, then increasing the voltage supplied to the cathode intermittently, and then again reducing the voltage supplied to the cathode.

The method may further include sequentially increasing the voltage supplied to the cathode each time the voltage supplied to the cathode drops by as much as −10 V, and then again reducing the voltage supplied to the cathode. In this case, the voltage supplied to the cathode voltage may be increased to a value corresponding to an average of an initial voltage and a final voltage of a voltage falling period.

The emitter may be formed of Carbon NanoTubes (CNTs).

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention is described more fully hereinafter with reference to the accompanying drawings, in which exemplary embodiments of the present invention are shown. The present invention may, however, be embodied in different forms and should not be construed as being limited to the embodiments set forth herein. Rather, these embodiments are provided so that this disclosure is thorough and complete and fully conveys the scope of the present invention to those skilled in the art.

Figure 3:
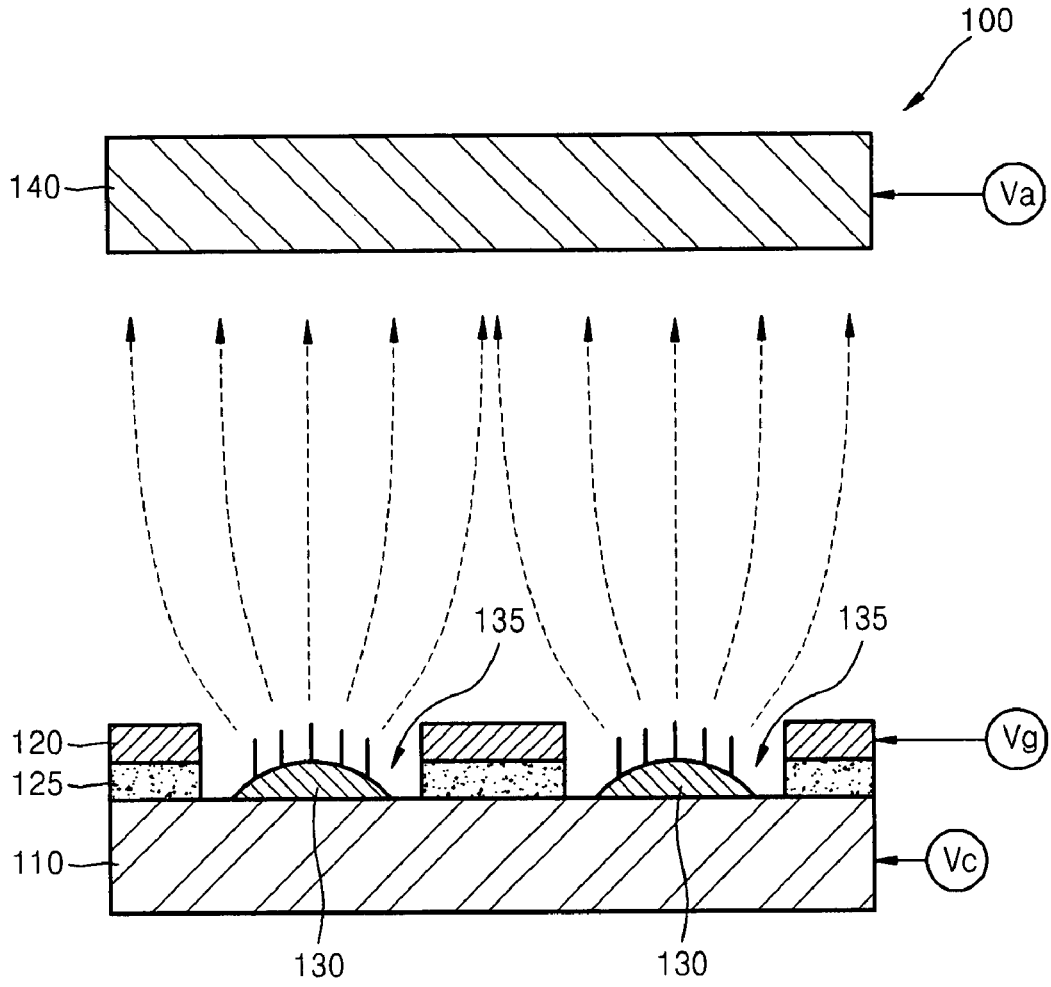
FIG. 3 (CONVENTIONAL ART)
FIG. 3 is a cross-sectional view of a conventional triode field emission device.
Figure 4:
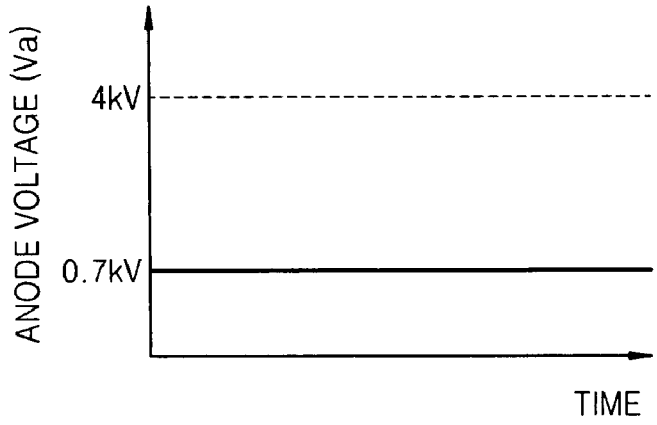
FIG. 4 is a graph of anode voltage with respect to time in a method of aging the triode field emission device of FIG. 3 according to an embodiment of the present invention.
Figure 5:
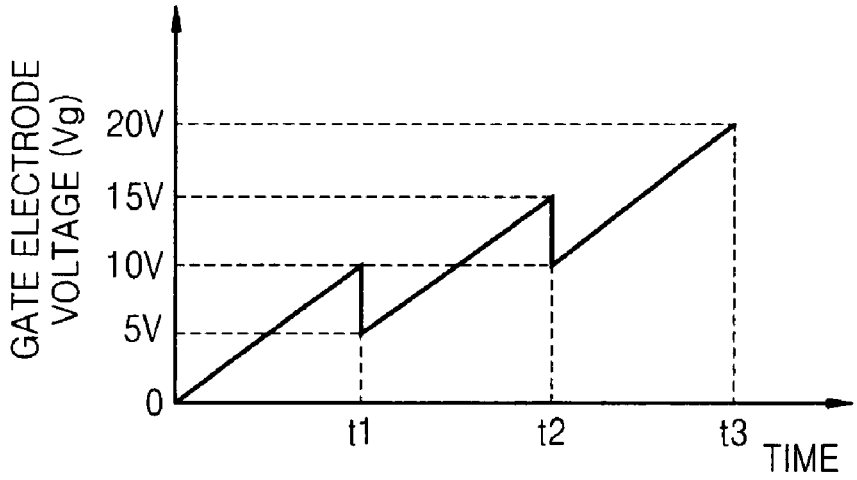
FIG. 5 is a graph of gate electrode voltage with respect to time in the method of aging the triode field emission device of FIG. 3 according to an embodiment of the present invention.
Figure 6:
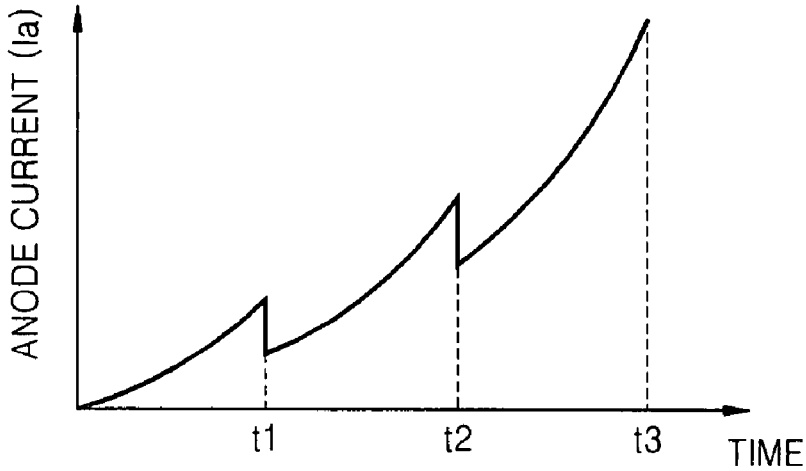
FIG. 6 is a graph of anode current with respect to time in the method of aging the triode field emission device of FIG. 3 according to an embodiment of the present invention.
Figure 7:
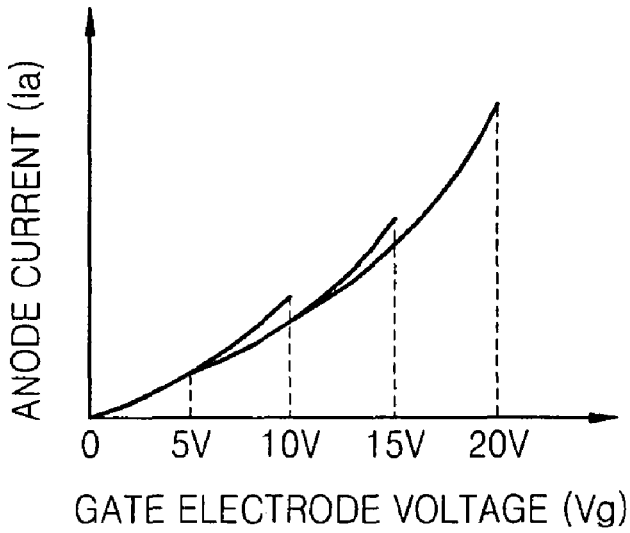
FIG. 7 is a graph of anode current with respect to gate electrode voltage in the method of aging the triode field emission device of FIG. 3 according to an embodiment of the present invention.
Figure 8:
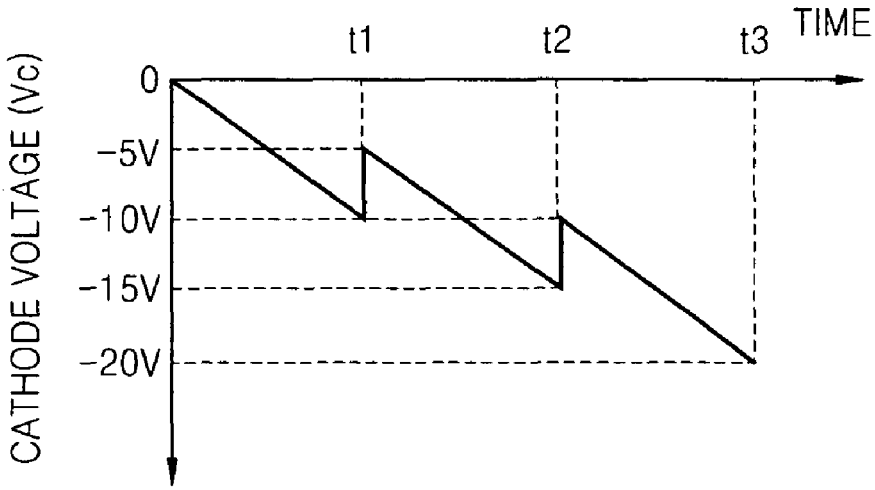
FIG. 8 is a graph of cathode voltage with respect to time in a method of aging the triode field emission device of FIG. 3 according to another embodiment of the present invention.

FIG. 3 is a schematic diagram of a conventional triode field emission device 100, FIG. 4 is a graph of anode voltage with respect to time in a method of aging the triode field emission device 100 according to an embodiment of the present invention, FIG. 5 is a graph of gate electrode voltage with respect to time in the method of aging the triode field emission device 100 according to an embodiment of the present invention, FIG. 6 is a graph of anode current with respect to time in the method of aging the triode field emission device 100 according to an embodiment of the present invention, FIG. 7 is a graph of anode current with respect to gate electrode voltage in the method of aging the triode field emission device 100 according to the first embodiment of the present invention, and FIG. 8 is a graph of cathode voltage with respect to time in a method of aging the triode field 14 emission device 100 according to another embodiment of the present invention.

Referring to FIG. 3, the triode field emission device 100 includes a cathode 110 and an anode 140, which are disposed parallel to each other, a gate electrode 120, which is stacked on the cathode 110, an insulating layer 125, which is interposed between the cathode 110 and the gate electrode 120, and an emitter 130, which emits electrons. The emitter 130 is disposed inside an emitter hole 135, which is formed in the gate electrode 120. The emitter 130 is formed on the cathode 110 such that an electrical conduction path is formed between the emitter 130 and the cathode 110. The emitter 130 is formed of Carbon NanoTubes (CNTs) which have excellent electron emission characteristics. However, the emitter 130 may also be formed of silicon (Si) or molybdenum (Mo).

Electrons emitted from the emitter 130 travel toward the anode 140. A Field Emission Display (FED) using the triode field emission device 100 includes a fluorescent material layer (not shown) that is arranged on a surface of the anode 140, so that the electrons emitted from the emitter 130 may be accelerated and collide with the fluorescent material layer to emit light. An anode voltage Va is supplied to the anode 140, a gate electrode voltage Vg is supplied to the gate electrode 120, and a cathode voltage Vc is supplied to the cathode 110.

After the triode field emission device 100 is fabricated, a constant voltage is supplied to the anode 140 in an aging process according to an embodiment of the present invention. FIG. 4 is a graph of anode voltage with respect to time in the method of aging the triode field emission device 100 according to the current embodiment of the present invention. Normally, a DC voltage of 4 kV or higher is supplied as a constant voltage while driving the triode field emission device 100 as illustrated by a dotted line. However, a sufficiently low anode voltage Va is supplied to the anode 140 during the aging process such that a short-circuited portion between the cathode 110 and the gate electrode 120 in the emitter hole 135 is not damaged due to overcurrent. The anode voltage Va may be a DC voltage of 0.1 to 1 kV, for example, a DC voltage of 0.7 kV is supplied as illustrated by a solid line.

In the aging process, the cathode 110 is grounded to make the cathode voltage Vc a ground voltage, and a positive (+) voltage is supplied to the gate electrode 120 so that a potential difference between the gate electrode voltage Vg and the cathode voltage Vc is maintained within 200 V. The gate electrode voltage Vg may gradually rise from 0 V, intermittently drop, and rise again as shown in FIG. 5. The rising rate of the gate electrode voltage Vg may be 0 to 60 V/min. in each of a plurality of voltage rising periods (0 to t1, t1 to t2, and t2 to t3 in FIG. 5). While the gate electrode voltage Vg rises gently in the voltage rising periods, the gate electrode voltage Vg drops in a short period of time or instantaneously in a voltage falling period. After each voltage rising period ends, the gate electrode voltage Vg may be dropped to as low as a value corresponding to the average of an initial voltage and a final voltage of the corresponding voltage rising period.

Referring to FIG. 5, the gate electrode voltage Vg increases at a constant rising rate, drops each time the gate electrode voltage Vg rises by as much as 10 V, and increases again. Also, after each voltage rising period ends, the gate electrode voltage Vg drops to a value corresponding to the average of the initial voltage and the final voltage of the corresponding voltage rising period. Specifically, the gate electrode voltage Vg rises from 0 V to 10 V in the period "0 to t1", drops to 5 V at a point in time t1, rises again from 5 V to 15 V in the period "t1 to t2", drops to 10 V at a point in time t2, and rises again.

Due to the above-described anode voltage Va, gate electrode voltage Vg, and cathode voltage Vc, an anode current Ia as shown in FIG. 6 is supplied to the anode 140. The gate electrode voltage Vg is graphed as a linear function with a constant rising rate as shown in FIG. 5, while the anode current Ia is graphed as an exponential function. Based on the graphs of FIGS. 5 and 6, a relationship between the gate electrode voltage Vg and the anode current Ia is shown in FIG. 7.

Figure 1A:
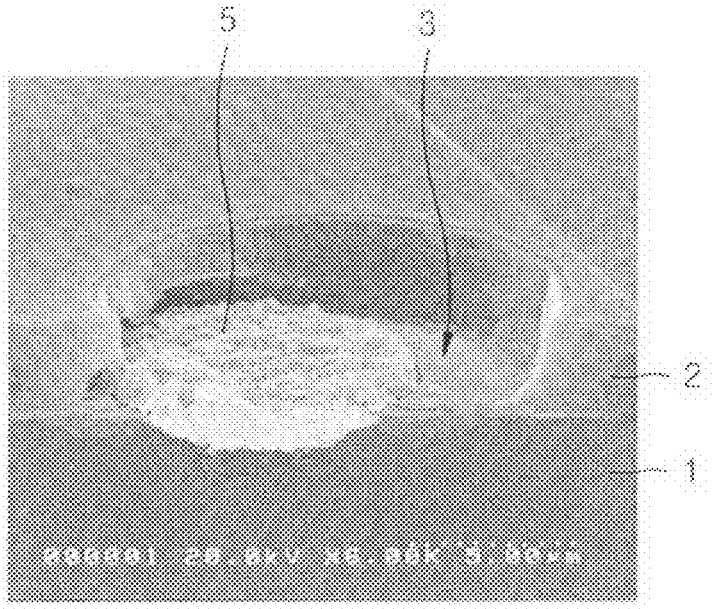
FIGS. 1A through 1C are schematic illustrations of types of short circuits of a triode field emission device.
Figure 1B:
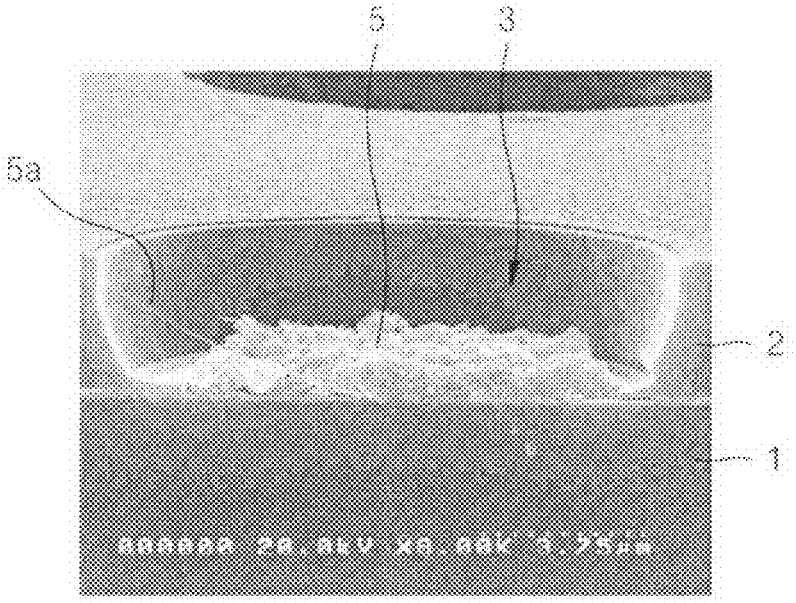
Figure 1C:
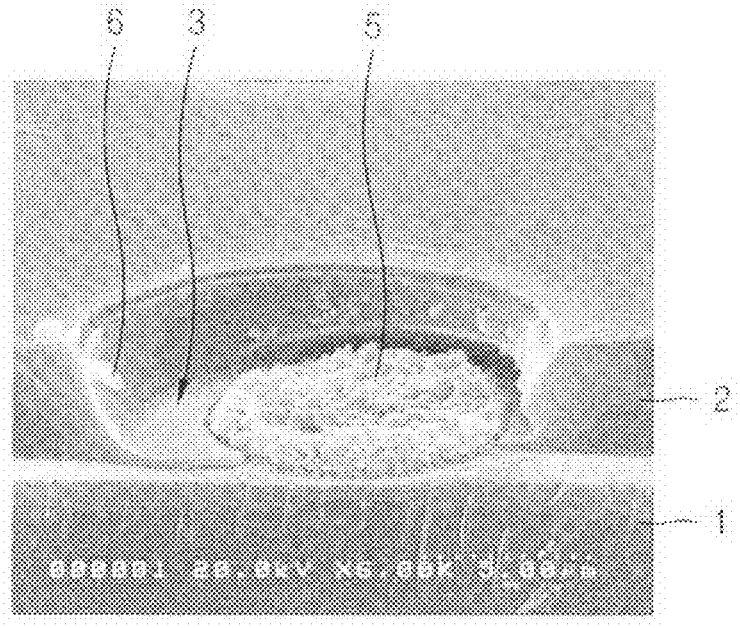
Figure 2:
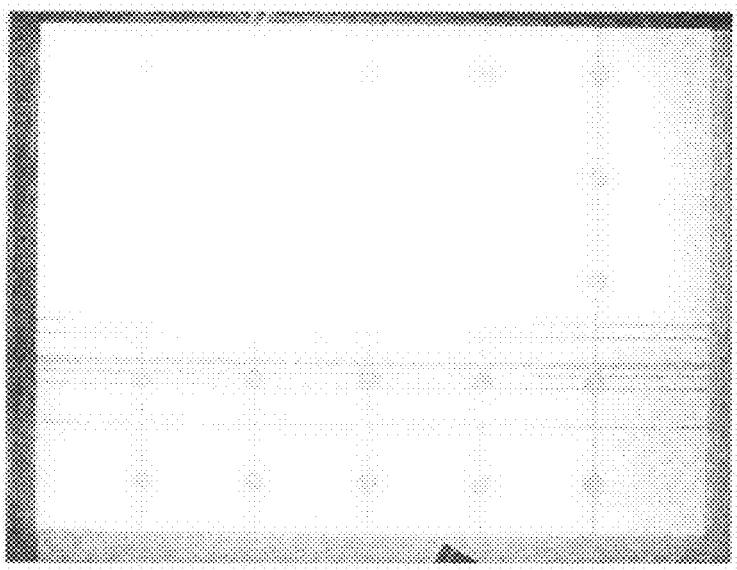
FIG. 2 is a schematic illustration of a Field Emission Display (FED) that has been permanently damaged after a conventional aging process.

When the aging process according to the current embodiment of the present invention is performed with the supplication of a low anode voltage Va and a gently rising gate electrode voltage Vg, small arcs occur in portions (namely, a portion of the emitter 5 that contacts the gate electrode 2 as shown in FIG. 1A, a portion of the emitter 5 that extends like a fine thread as shown in FIG. 1B, and an extraneous substance shown in FIG. 1C) that bring about a short circuit between the gate electrode 120 and the cathode 110, thus removing the portions. These arcs are not great enough to permanently damage the short circuit and its adjacent portions in the triode field emission device 100. Therefore, the aging process according to the present invention is capable of overcoming the problem of short circuits such that the triode field emission device 100 can operate normally.

On the other hand, an aging process may be performed by use of the gate electrode voltage Vg that continuously rises at a rate of 0 to 60 V/min. without intermittently dropping. Alternatively, in an aging process, the gate electrode 120 may be grounded and a negative (−) voltage may be supplied to the cathode 110 so that a potential difference between the gate electrode Vg and the cathode voltage Vc is maintained within 200 V. In this case, the cathode voltage Vc may gradually drop from 0 V, intermittently rise, and drop again as shown in FIG. 8. The falling rate of the cathode voltage Vc may be 0 to −60 V/min in each of a plurality of voltage falling periods (0 to t1, t1 to t2, and t2 to t3 in FIG. 8). While the cathode voltage Vc rises intermittently, the cathode voltage Vc rises in a short period of time or instantaneously. After each voltage falling period ends, the cathode voltage Vc may be elevated to as high as a value corresponding to the average of an initial voltage and a final voltage of the corresponding voltage falling period.

Referring to FIG. 8, the cathode voltage Vc decreases at a constant falling rate, rises each time the cathode voltage Vc drops as much as 10 V, and decreases again. Also, after each voltage falling period ends, the cathode voltage Vc rises to a value corresponding to the average of the initial voltage and the final voltage of the corresponding voltage falling period. Specifically, the cathode voltage Vc drops from 0 V to −10 V in the period "0 to t1", rises to −5 V at a point in time t1, drops again from −5 V to −15 V in the period "t1 to t2", rises to −10 V at a point in time t2, and drops again. On the other hand, an aging process may be performed by use of the cathode voltage Vc that continuously drops at a rate of 0 to −60 V/min. without intermittently rising.

Figure 9:
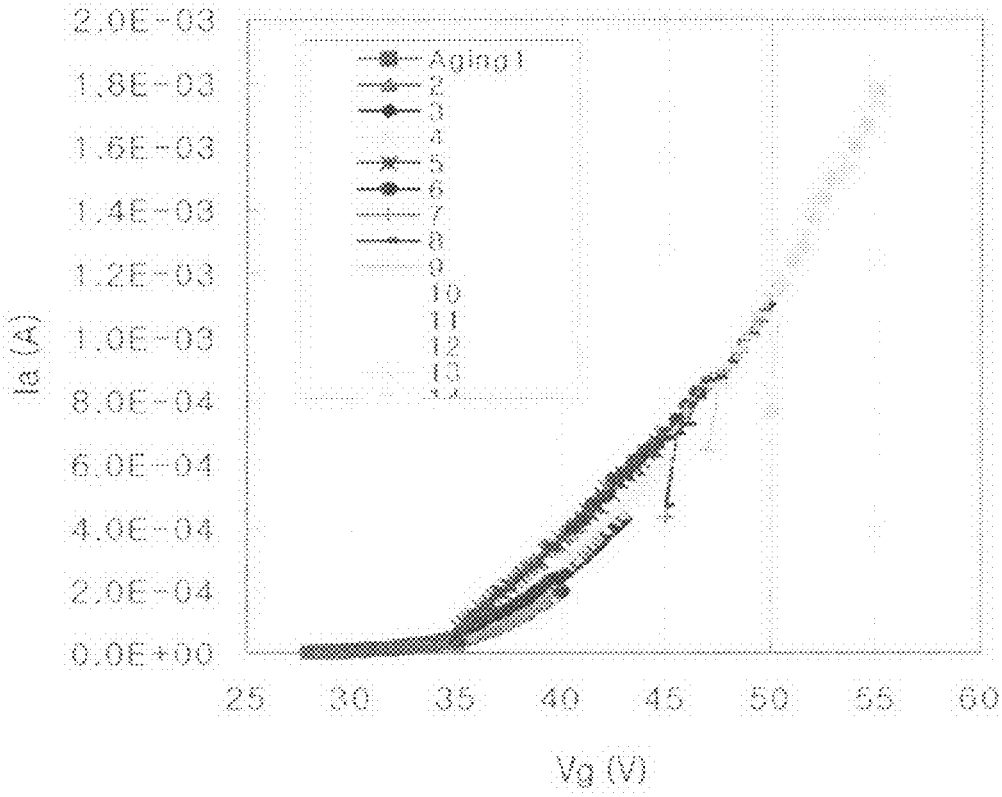
FIG. 9 is a graph of anode current with respect to gate electrode voltage in a method of aging a field emission device according to an embodiment of the present invention.
Figure 10A:
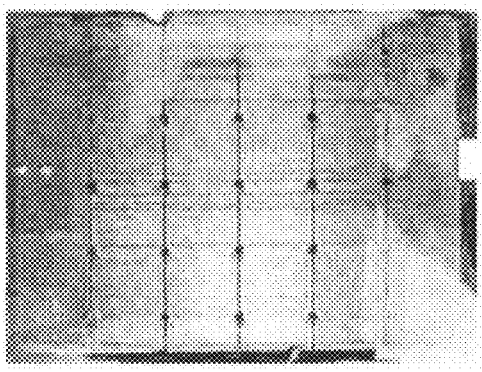
FIGS. 10A through 10H are schematic plan views of a short-circuited portion of a FED being gradually repaired using an aging process according to an embodiment of the present invention.
Figure 10B:
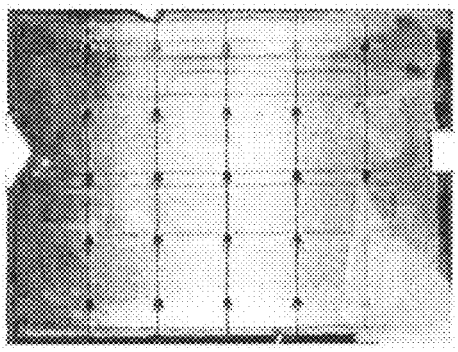
Figure 10C:
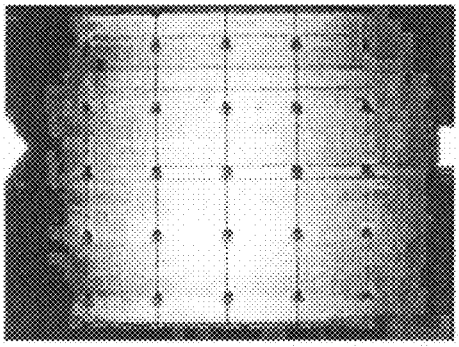
Figure 10D:
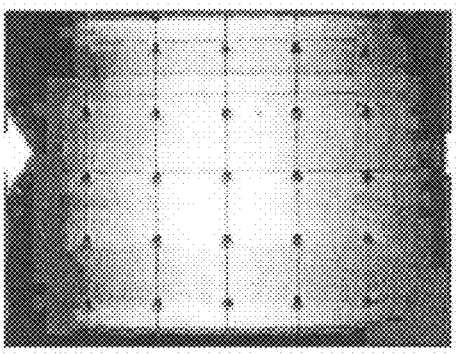
Figure 10E:
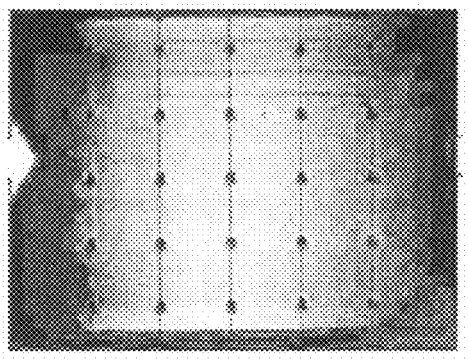
Figure 10F:
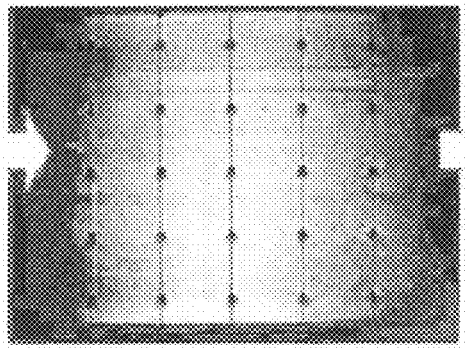
Figure 10G:
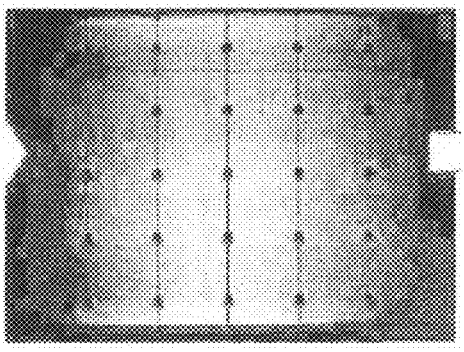
Figure 10H:
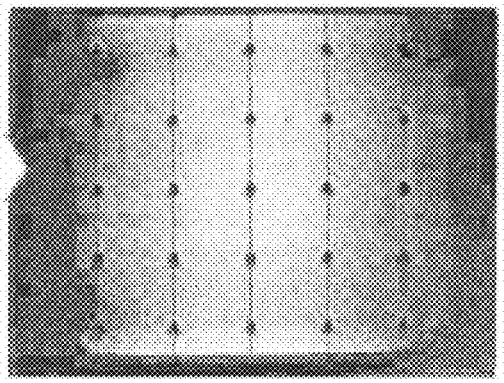
Figure 11:
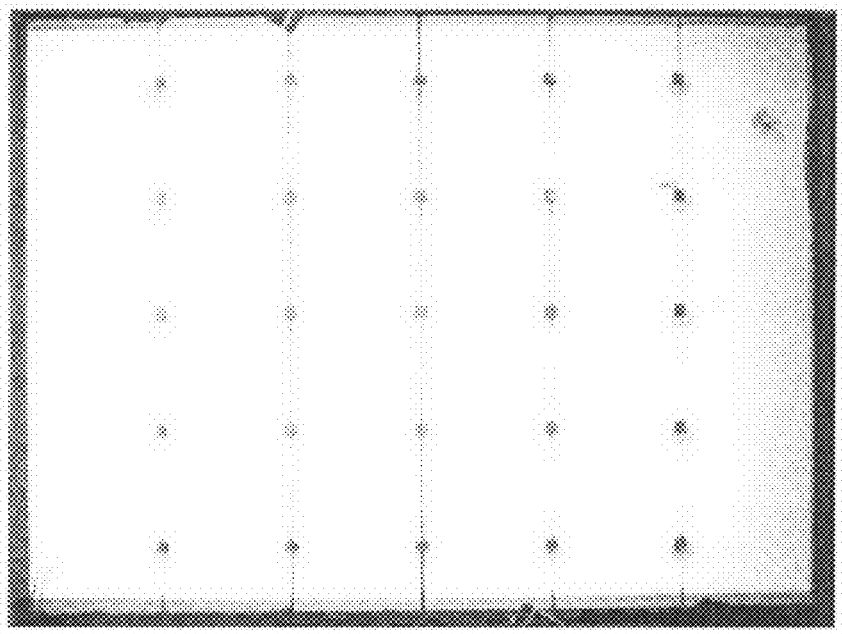
FIG. 11 is a schematic plain view of a repaired FED using an aging process according to an embodiment of the present invention.

FIG. 9 is a graph of anode current with respect to gate electrode voltage in a method of aging a field emission device according to an embodiment of the present invention, FIGS. 10A through 10H are photographic images showing that a short-circuited portion of a FED 20 is gradually repaired using the aging process according to the current embodiment of the present invention, and FIG. 11 is a photographic image of the FED repaired through the aging process according to the current embodiment of the present invention.

The present inventor has confirmed the effects of an aging process according to the present invention by photographing changes that were made in an FED after performing the aging process on the FED. The aging process was conducted under conditions in which the anode voltage Va was a constant DC voltage of 0.7 V and the cathode voltage Vc was a ground voltage. Also, referring to FIG. 9, the gate electrode voltage Vg gently rose from 0 V to 55 V over about 1 hour. Specifically, the gate electrode voltage Vg increased, intermittently dropped, and then increased again.

Referring to FIG. 10A, which shows an initial stage of the aging process where the gate electrode voltage Vg was 39.1 V and an anode current Ia was 200 μA, 10 horizontal lines where light was not emitted due to short circuits between a cathode and a gate electrode were observed. However, as aging time went by, small arcs occurred occasionally in short-circuited portions, thereby overcoming the problem of the short-circuited portions. As a result, the number of horizontal lines where light was not emitted was reduced as shown in FIGS. 10B through 10G, and the horizontal lines finally disappeared as shown in FIG. 10H. When the FED in which the horizontal lines disappeared by this aging method was driven under typical driving conditions, the horizontal lines where light had not been emitted did not appear again, but the FED was operated normally as illustrated in FIG. 11. The typical driving conditions that were supplied to a driving test of the FED were: anode voltage Va=4.0 kV, gate electrode voltage Vg=37.8 V, cathode voltage Vc=ground voltage, anode current Ia=1.0 mA.

Using the method of aging a field emission device according to the present invention as described above, the problem of short circuits produced during the fabrication of the triode field emission device can be overcome such that the field emission device can operate normally. Therefore, the failure rates of a field emission device and display device using the field emission device can be lessened, thus reducing a waste of resources and lowering fabrication costs.

While the present invention has been particularly shown and described with reference to embodiments thereof, it will be understood by those of ordinary skill in the art that various modifications in form and detail may be made therein without departing from the spirit and scope of the present invention as defined by the following claims.

What is claimed is:

1. A method of aging a field emission device including a cathode and an anode arranged parallel to each other, an emitter arranged on the cathode to emit electrons to the anode, and a gate electrode arranged on the cathode adjacent to the emitter, the method comprising: supplying a ground voltage to the cathode; supplying a positive (+) voltage to the gate electrode; supplying a sufficiently low voltage to the anode so as to prevent a short-circuited portion between the cathode and the gate electrode from being damaged due to an overcurrent; and increasing the voltage supplied to the gate electrode at a rising rate of 0 to 60 V/min, wherein a potential difference between the gate electrode and the cathode ranges from 0 to 200 V.

2. The method of claim 1, comprising dropping the voltage supplied to the gate electrode intermittently and then again increasing the voltage supplied to the gate electrode, after the increasing the voltage supplied to the gate electrode at a rising rate of 0 to 60 V/min.

3. The method of claim 2, comprising reducing the voltage supplied to the gate electrode each time the voltage of the gate electrode rises by as much as 10 V, and then again increasing the voltage supplied to the gate electrode; wherein the voltage supplied to the gate electrode voltage is reduced to a value corresponding to an average of an initial voltage and a final voltage of a voltage rising period.

4. The method of claim 1, wherein the emitter comprises Carbon Nanolubes (CNTs).

5. The method of claim 1, wherein the voltage supplied to the anode is a DC voltage ranging from 0.1 to 1 kV.

6. The method of claim 1, wherein a constant voltage is supplied to the anode.

7. A method of aging a field emission device including a cathode and an anode arranged parallel to each other, an emitter arranged on the cathode to emit electrons to the anode, and a gate electrode arranged on the cathode adjacent to the emitter, the method comprising: supplying a negative (−) voltage to the cathode; supplying a ground voltage to the gate electrode; supplying a sufficiently low voltage to the anode so as to prevent a short-circuited portion between the cathode and the gate electrode from being damaged due to an overcurrent, and reducing the voltage supplied to the cathode at a falling rate of 0 to −60 V/min, wherein a potential difference between the gate electrode and the cathode ranges from 0 to 200 V.

8. The method of claim 7, comprising sequentially reducing the voltage supplied to the cathode at a falling rate of 0 to −60 V/min, then increasing the voltage supplied to the cathode intermittently, and then again reducing the voltage supplied to the cathode.

9. The method of claim 8, comprising increasing the voltage supplied to the cathode each time the voltage supplied to the cathode drops by as much as −10 V, and then again reducing the voltage supplied to the cathode; wherein the voltage supplied to the cathode is increased to a value corresponding to an average of an initial voltage and a final voltage of a voltage falling period.

10. The method of claim 7, wherein the emitter comprises Carbon NanoTubes (CNTs).

11. The method of claim 7, wherein the voltage supplied to the anode is a DC voltage ranging from 0.1 to 1 kV.

12. The method of claim 7, wherein a constant voltage is supplied to the anode.

* * * * *